US007124783B2

(12) United States Patent
Powell et al.

(10) Patent No.: US 7,124,783 B2
(45) Date of Patent: Oct. 24, 2006

(54) HIGH SPEED YARN TRANSFER SYSTEM INCORPORATING REVERSING LINKAGE AND ELECTRO-OPTICAL SYNCHRONIZATION

(75) Inventors: Simon Powell, Royston (GB); Paul Michael Weaver, Bishop's Stortford (GB)

(73) Assignee: PBT (IP) Limited(GB)

( * ) Notice: Subject to any disclaimer, the term of this patent is extended or adjusted under 35 U.S.C. 154(b) by 30 days.

(21) Appl. No.: 10/490,130

(22) PCT Filed: Sep. 17, 2002

(86) PCT No.: PCT/GB02/04224

§ 371 (c)(1),
(2), (4) Date: Sep. 16, 2004

(87) PCT Pub. No.: WO03/025272

PCT Pub. Date: Mar. 27, 2003

(65) Prior Publication Data

US 2005/0016616 A1 Jan. 27, 2005

(30) Foreign Application Priority Data

Sep. 17, 2001 (GB) ..... 0122406.2
Jul. 31, 2002 (GB) ..... 0217734.3

(51) Int. Cl.
*D03D 47/24* (2006.01)

(52) U.S. Cl. ..... 139/438

(58) Field of Classification Search ..... 139/116.1, 139/438, 444–445, 216, 273 R, 275
See application file for complete search history.

(56) References Cited

U.S. PATENT DOCUMENTS 4,009,737 A * 3/1977 Rohr et al. ..... 139/370.2
6,119,733 A * 9/2000 Arndt et al. ..... 139/453
6,305,434 B1 * 10/2001 Speich ..... 139/448

FOREIGN PATENT DOCUMENTS

EP 0690160 A1 * 1/1996
EP 0 864 678 A1 9/1998
GB 2 059 455 A 4/1981
WO WO 99/60193 11/1999

* cited by examiner

*Primary Examiner*—John Calvert
*Assistant Examiner*—Andrew W. Sutton
(74) *Attorney, Agent, or Firm*—Renner, Kenner, Greive, Bobak, Taylor & Weber

(57) ABSTRACT

A rapier for a rapier loom comprises:—a low mass self-tightening rotary clamp with its axis of rotation aligned to the direction of maximum acceleration;—a collapsing pivot linkage that converts the force used to close the self-tightening clamp into the force used to open it;—a piezo-electric trigger device system that controls the change of state of the collapsing pivot linkage wherein the device is charged at the start of the insertion cycle and discharged at the centre of the loom to change the state of the system; and an electronic circuit comprising a photo-transistor that is connected with the piezo-electric of the trigger system such that when a suitable level of light is introduced to the device the actuator becomes discharged

4 Claims, 6 Drawing Sheets

HIGH SPEED YARN TRANSFER SYSTEM INCORPORATING REVERSING LINKAGE AND ELECTRO-OPTICAL SYNCHRONIZATION

BACKGROUND

Rapier looms are known and are distinguished from other types of loom by the nature in which the yarn is moved through the warp threads. On a traditional shuttle loom a quantity of yarn is carried on the shuttle and the assembly is projected through the warp threads to the other side of the loom.

The primary benefit of a rapier loom is that the yarn is pulled from the main spool, reducing waste and increasing speed. In order to maintain stiffness of the insertion part and the speed of weaving, there are two rapiers on the loom, and the yarn is handed over at the centre of the shed. The yarn is fed by a part commonly termed the giver and is collected by a part termed the taker.

In order to effect a consistent weave it is essential that the yarn is held reliably and can be freely released by the giver at the centre. Some rapiers, termed negative rapiers, use vee slots to capture the yarn and rely upon friction to hold it during the insertion process. Other devices, most specifically those manufactured by Dornier, are termed positive rapiers and use a spring clamp that is opened at the centre of the loom by external fingers pressing upon suitable release faces.

Negative rapiers have two key disadvantages. Firstly, not all yarns can be woven, due to the relationship of friction and fibre stiffness. Secondly, the yarn must travel through the vee during the capture process so high wear can occur, resulting in material being wasted.

Positive rapiers have the disadvantage that the insertion parts are of high mass causing the maximum speed of weaving to be much lower, resulting in productivity losses. The external fingers can also cause damage to the warp threads, creating an imperfection in the yarn.

It is impractical to mount a stored energy system such as a capacitor and solenoid upon the rapier arms, because the energy density to mass ratio is very poor. In any high speed reciprocating system, mass is a serious impediment, because acceleration will decrease for a given force as the mass increases, from F=ma. Any energy store will greatly increase the inertia in the system.

In a negative rapier loom the heads can accelerate at up to 5000 $ms^{-2}$, equivalent to 500 gravities. Any weight therefore acts as if it is 500 times heavier. To keep the clamps of a positive rapier closed under such forces stiff springs are used. The springs act like masses and so slow down the opening at the centre of the loom, limiting the operating speed further.

It will be beneficial to eliminate the need to overcome the closure springs at the time the system condition needs to be changed. It is further beneficial to reduce the force needed to close upon and retain the yarn.

It is further a feature of high speed devices that the forces within the system cause elongation and associated shape changes in the working parts. Some rapier systems use rods to insert the heads whereas others use stiff belts, preferably reinforced with carbon fibre. These belts elongate under the acceleration, changing the physical relationship of the heads, and so making the handover process speed dependent. Setting up the loom at low speeds requires consideration of the behaviour of the belts and anticipation of the weave speed. It will be beneficial to be able to dynamically alter the loom timing by some electronic means.

SUMMARY OF THE INVENTION

According to the present invention there is provided a system that comprises:

a low mass self-tightening rotary clamp with its axis of rotation aligned to the direction of maximum acceleration.

a collapsing pivot linkage that converts the force used to close the self-tightening clamp into the force used to open it;

a piezo-electric trigger device system that controls the change of state of the collapsing pivot linkage wherein the device is charged at the start of the insertion cycle and discharged at the centre of the loom to change the state of the system;

an electronic circuit comprising a photo-transistor that is connected with the piezo-electric of the trigger system such that when a suitable level of light is introduced to the device the actuator becomes discharged.

DESCRIPTION OF INVENTION

An embodiment of the invention is now described with the aid of the accompanying figures by way of illustration only.

Figure 1A:
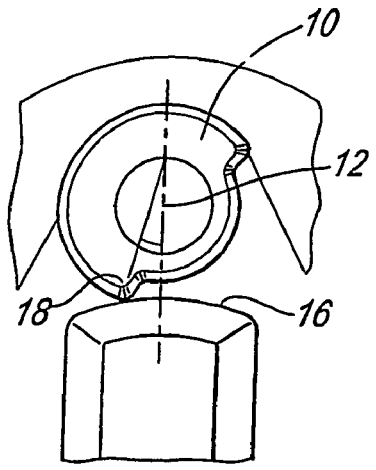
FIGS. 1*a* and 1*b* show different states of the rotary clamp component.
Figure 1B:
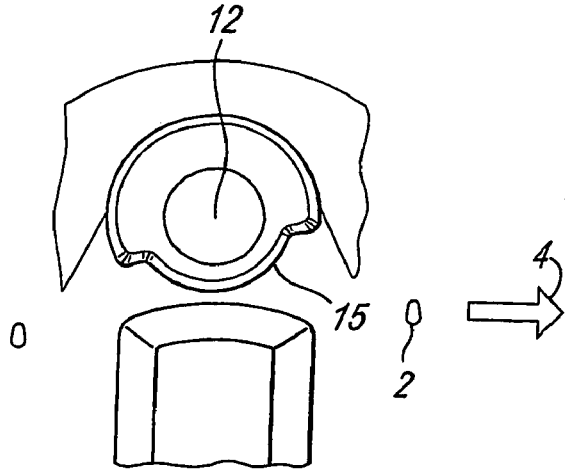
Figure 2:
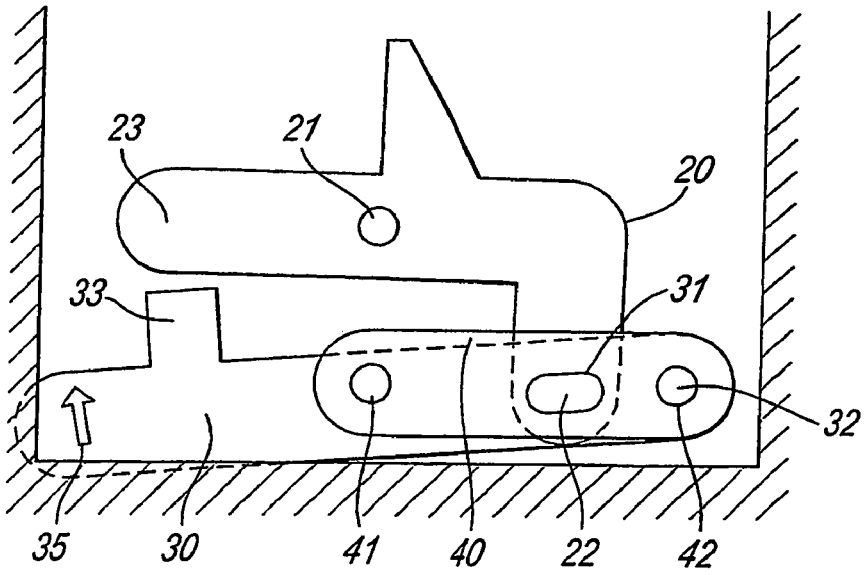
FIG. 2 shows the first stage of the process using 3 primary linkages
Figure 3:
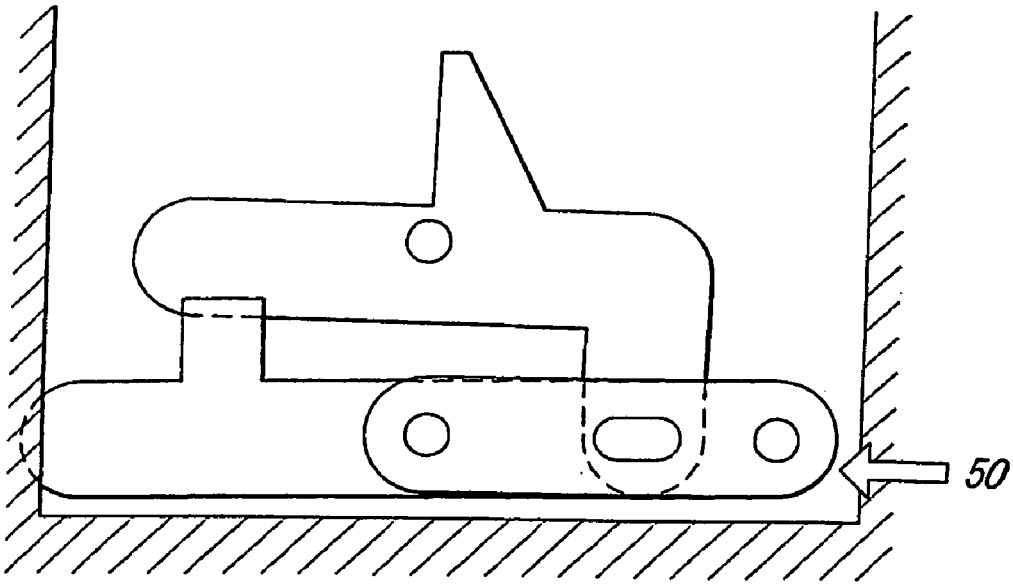
FIG. 3 shows the second stage of the process using 3 primary linkages.
Figure 4:
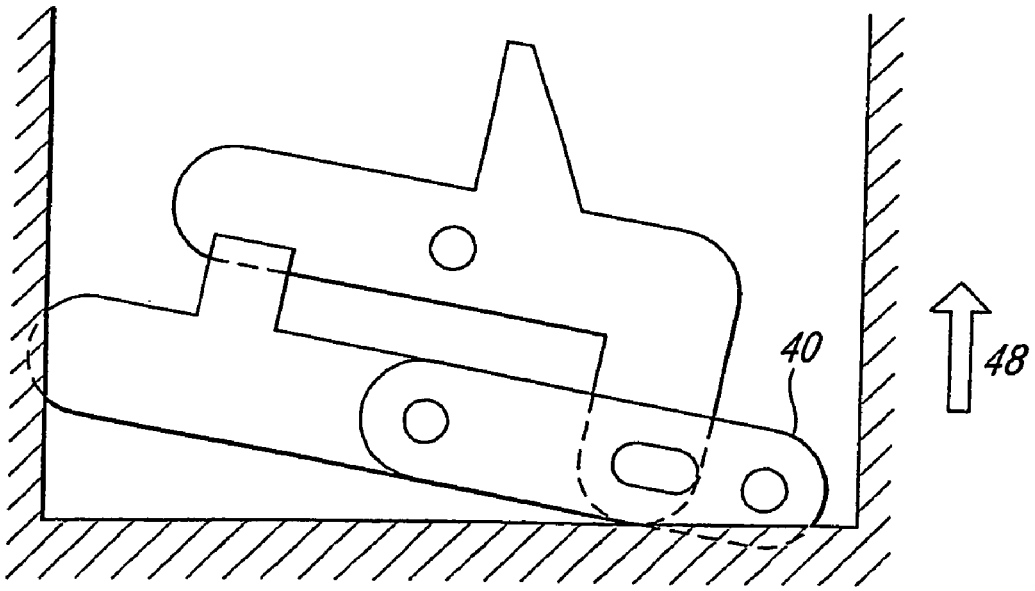
FIG. 4 shows the third stage of the process using 3 primary linkages.

Consider first the rotary clamp component, as shown in FIG. 1.

In FIG. 1, there is provided a cylinder (10) rotating in a pivot (12) whose axis of rotation (14) is in the direction of maximum acceleration of the insertion process. The face of the cylinder (10) is relieved for a portion of the circumference (15) by an amount suitable to permit the entry and exit of all weavable yarn thicknesses.

A suitably shaped clamping surface (16) is rigidly fixed with respect to the pivot (12) such that it interferes with the unrelieved face of the cylinder (10) but does not interfere with the relieved portion (15).

The leading corner of the transition from relieved to unrelieved portion (18) contacts the clamping surface (16) such that the point of contact cannot move vertically beneath the pivot (12) and preferably the line of contact forms an angle of between five and fifteen degrees to the vertical with respect to the centreline of the main axis (12).

A yarn (2) introduced into the gap between the two surfaces is initially clamped by the torsion of a light spring that is not shown and is of any suitable construction acting upon the cylinder (10). The application of tension to the yarn (2) in the direction of rotation of the clamp (4) creates a torque moment due to the friction between the clamp surface (16) and the yarn (2). This torque is translated into a vertical and horizontal component that is defined by Cos(θ), where θ is the relative angle of the line of contact from the centre to the contact point with respect to the vertical. The shallow angle means that the bulk of the torque is converted into clamping force, thus increasing the grip upon the yarn (2) in proportion to the tension upon it.

Consider next the method for changing the relationship of the force spring and the clamp part such that the pressure of closure becomes the acceleration force to open. FIGS. 2 to 5 show this method as a series of linkage diagrams and later as a production-typical assembly that fits within the typical envelope of a rapier loom.

The system comprises 3 primary linkages which are termed a clamp linkage (20), a reversing linkage (30) and a tumbler linkage (40).

The clamping linkage (20) has a fixed pivot (21), a first acting pivot (22) and a second acting pivot (23). The clamp cylinder (10) is rigidly connected to this linkage and rotates around the axis of the fixed pivot (21).

The reversing linkage (30) has a coupling pivot (31) that is rotably connected to the first acting pivot (22) of the clamp linkage (20). To one side of the coupling pivot (31) there is a reaction pivot (32). Either of these pivots will be slotted to permit lateral motion of the other parts and for this illustration it is the coupling pivot (31) that is shown thus. To the other side of the coupling pivot (31) there is a reversing interface (33) such that the assembly of the reversing linkage (30) and the clamp linkage (20) can rotate around the first acting pivot (22) until the second acting pivot (23) meets the reversing interface (33). A force generator of any suitable design, such as a spring exerts a force on the same side as the reversing slot, creating a rotational moment around the coupling pivot (31) and this force is shown as the arrow (35).

The tumbler linkage (40) has a fixed pivot (41) which may conveniently but not necessarily be co-axial with the fixed pivot (21) of the clamp linkage (20). The tumbler linkage also has a link pivot (42) that is rotably connected to the reaction pivot (32) of the reversing linkage (30). The tumbler linkage (40) is constructed in such a way that the operation of a suitable trigger device causes the link pivot (42) to become free to rotate around the fixed pivot (41) and so deprive the force (35) of a reaction surface around the coupling pivot (31). For convenience the tumbler linkage (40) is shown in the figures as a simple pivoting bar, but the function can be provided by an energized gas cylinder, a knee-break mechanism, a cam or any other suitable device.

In the case of the pivoting bar the linkage (40) is prevented from rotation by the presence of a commonly available detent (50).

Consider the system with the detent (50) in place. The force (35) creates a torque moment around the coupling pivot (31). The free rotation of the reversing linkage (30) is prevented by the fixing of the reaction pivot (32) via the link pivot (42), so the force (35) results in an upwards force being exerted by the coupling pivot (31). The clamp linkage (20) is free to rotate around the fixed pivot (21) and so the force acting on the coupling pivot (31) creates a rotation of the clamp linkage (20) in the anti-clockwise direction. The clamp faces are not shown but are configured to meet before the rotation of the clamp linkage (20) causes the second acting pivot (23) to contact the reversing interface (33). When the clamp faces meet the free rotation of the clamp linkage (20) ceases and the system reaches an equilibrium point through the counter rotation of the linkage bar (30) around the coupling pivot (32), causing the second acting pivot (23) to move anti-clockwise towards the reversing interface (33). The system is designed such that the equilibrium point is reached before the second acting pivot (23) actually contacts the reversing interface (33).

When it is desired to change the state of the system from closed to open the detent (50) is withdrawn by any suitable means. This permits the free rotation of the tumbler linkage (40) under the reaction force exerted via the reaction pivot (32). The loss of the fixed reaction surface causes the mechanism to lose its equilibrium condition and the force that was previously being exerted upwards through the coupling pivot (31) becomes a torque moment around the reaction pivot (32). The clamp linkage (20) therefore rotates clockwise as does the reversing linkage (30), pivoting around the coupling pivot (31). The second acting pivot (23) quickly meets the reversing interface (33) such that the force (35) now exerts a large clockwise torque, rapidly accelerating the clamp linkage (20).

The system is reset by rotation of the tumbler linkage (40) in the direction of the reset force arrow (48). It is a beneficial feature of this process that the clamp pressure between the fixed clamp face (16) and the rotating clamp face (10) increases slowly after the faces contact, decreasing the instantaneous stresses upon the yarn (2).

Figure 5:
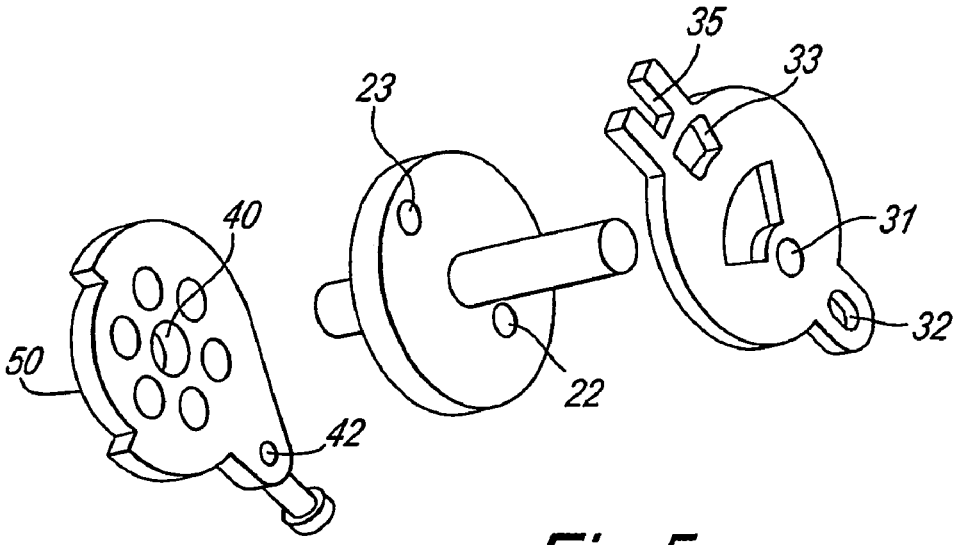
FIG. 5 shows the construction of the mechanism of FIGS. 2, 3 and 4 using circular plates.

The mechanism as described above can conveniently be constructed by placing the individual linkages one on top of the other in the manner of plates. FIG. 5 shows an identical mechanism to that already described embodied in circular plates that are balanced around their axis of rotation to reduce the creation of unwanted forces.

Consider now the piezo-electric or electrostrictive trigger device which for convenience will hereafter be called just piezo electric devices.

Piezo-electric devices in the forms of stacks and benders are known. It is a feature of all piezo-electric devices that they act as capacitors, being a dielectric ceramic with electrodes.

It is a further feature of piezo-electric devices that they have very small movement. An exception to this feature is the planar bimorph actuator which is known. A feature of the planar bimorph actuator is that the force capability of the device is lower, typically 0.25N maximum.

Figure 6:
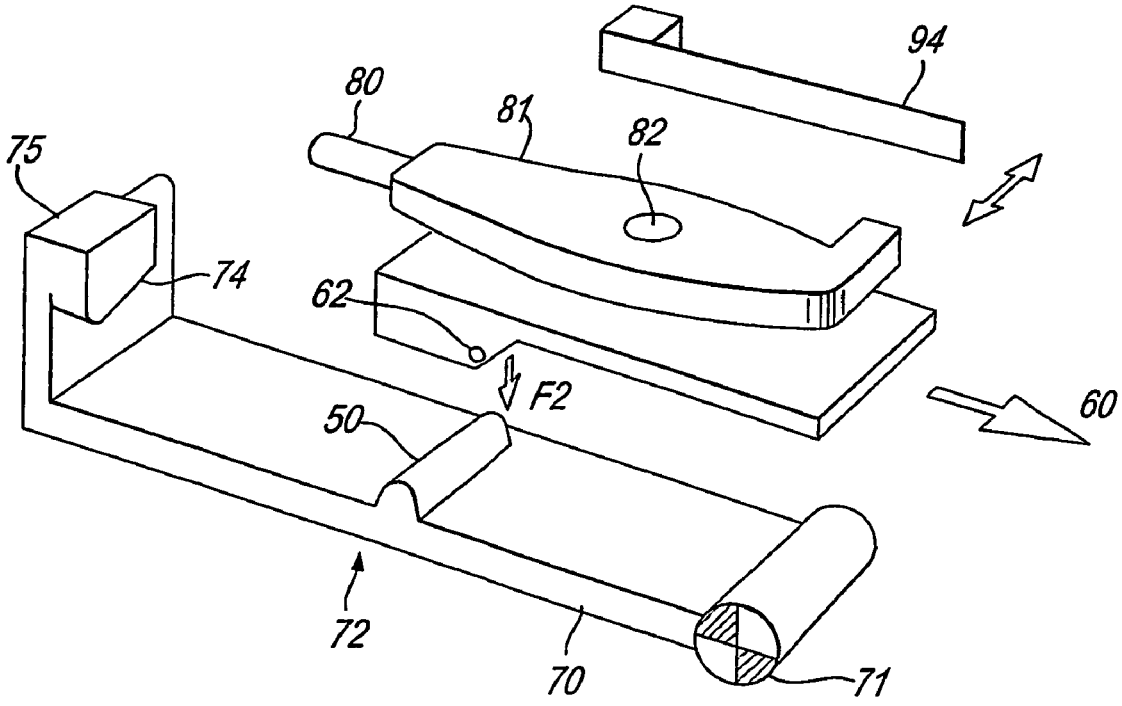
FIG. 6 shows an exploded perspective view of a mechanism for explaining the methodology for using a planar bimorph or any other low force actuator to release a high force system.

FIG. 6 explains a methodology for using a planar bimorph or any other low force actuator to release a high force system. Specifically, the illustrated construction can be used to release the tumbler linkage (40) of the invention.

Figure 6A:
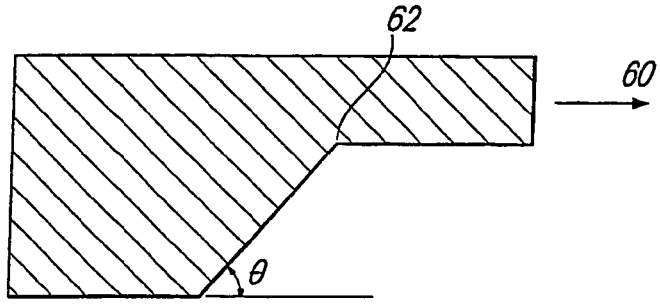
FIGS. 6*a* and 6*b* show angles of parts of the mechanism shown in FIG. 6.

A primary force to be retained (60) is created through any suitable mechanism. The mechanism provides an angled face (62) of suitable materials. In order for the mechanism to discharge its stored energy it is necessary for the angled face (62) to move past the detent (50) feature of the actuator system. The angle of the face (62) can be set to any convenient angle, but is governed by the equation:

$$\theta > 90 - A \tan \mu + \theta_1$$

Where θ is the angle measured perpendicular to the force (60) and identified in FIG. 6*a*.

μ is the co-efficient of friction of the material to the detent (50), typically 0.2 and $\theta_1$ is the required angle of acceleration, typically 5 degrees but any suitable value can be used.

The vertical component of the force (60) $F_2$ when the angle of acceleration is 5 degrees is approximately 0.0875 of the force, calculated by $F_2=F_1 \tan(\theta)$.

The detent (50) feature is mounted upon a spring beam (70) that is rotably attached to a fixed point (71) at one end and at the other end is free to rotate under the influence of the spring force (72) that operates to push the detent feature (50) into contact with the angled face (62).

The spring rate of the spring and the condition of the system are such that the vertical resultant F2 is sufficient to cause the beam (70) to deflect by more than the interference distance between the detent (50) and the angled face (62). In this case the detent (50) system permits the free travel of the angled face (62).

At the free end of the beam is provided with an interface portion (75). The interface portion provides a face (76) that is angled with respect to the direction of free travel.

Figure 6B:
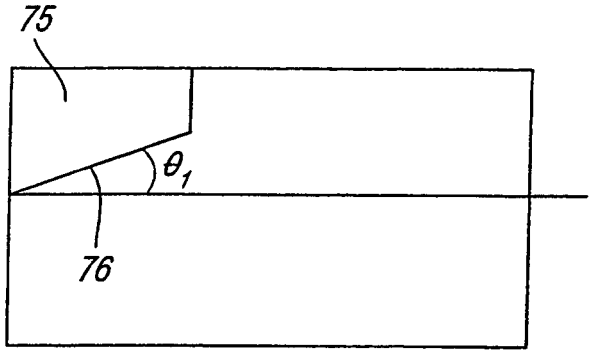

The angle of the face (76) is such that it creates a sideways moment from the force of the detent (50) to angled pin action. The angle of the face is determined by the equation $$\theta_1 = 90 - A \tan \mu$$

Where $\theta_1$ is the angle measured at the point shown in FIG. 6*b* and μ is the co-efficient of friction of the material to the detent (65), typically 0.2.

If the frictional co-efficient is 0.2 the angle will be approximately 11 degrees to the horizontal.

An interlock pin (80) is connected to any suitable piezo-electric or electrostrictive actuator that can insert the pin (80) underneath the angled face (76).

Insertion of the pin changes the stiffness of the beam such that the vertical resultant force F2 is insufficient to push the detent out of the path of the angled face (62) and so the system is locked. In high speed oscillating systems it is a further significant advantage if the force required to move the system to the open condition is a large multiple of the resultant force F2.

Piezo benders have to be made of thin material so the physical strength of the parts is low. Directly fixing the pin (80) to the actuator will limit the downward force that can be supported. Preferably therefore the pin (80) is upon a balanced beam (81) that is of very low mass, has a high beam stiffness by virtue of materials and geometry and has a pivot (82) such that the actuator must be energized to cause the pin (80) to be inserted beneath the locking face (76).

Figure 7:
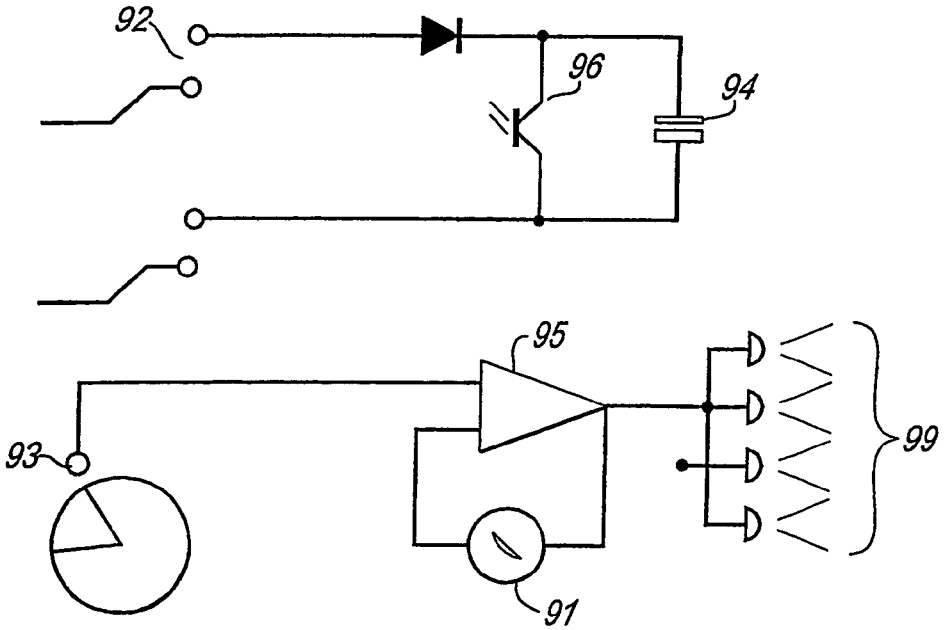
FIG. 7 shows a circuit formed by the actuator.

Consider now the energy supply to the piezo actuator. The actuator (94) forms a circuit as shown in FIG. 7. At the outside of the loom where the parts are accessible, contacts of any suitable form (92) apply a voltage to the actuator whilst the mechanism is being held in the reset condition.

The mechanism accelerate and decelerates in accordance with the required motion, coming to a point of minimum velocity and maximum acceleration at the centre of the loom. In parallel, with the actuator is provided a suitable array of photo-transistors (96) which are preferably tuned to work with non-visible light, such as infra-red.

A sensor on the machine (93) detects the position of the machine's synchronisation and determines a suitable angle before the parts reach the centre. A processor (95) applies a delay that is dependent upon the rotational speed of the loom, determined by any suitable means and then fires an array of emitters (99) that are matched to the absorption spectrum of the photo-transistors (96). The flash from the emitters (99) causes the photo-transistors (96) conduct and so discharge the piezo actuator (94). Upon discharging the actuator releases the mechanism as previously described. Suitable interfaces permit the operator to adjust the triggering event to compensate for elongation of parts under acceleration and the nature of the yarns being woven.

A further embodiment of the reversing linkage 30 used in the present invention will now be described with reference to FIG. 8.

Figure 8:
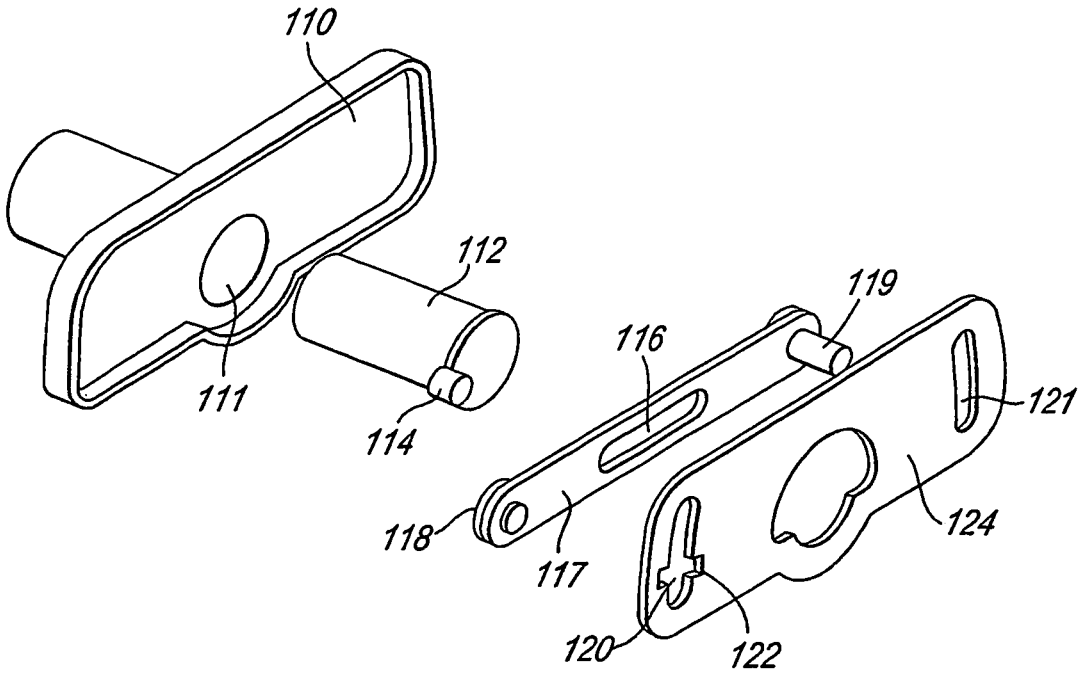
FIG. 8 is an exploded perspective view of a further embodiment of a reversing linkage for use in the present invention.

FIG. 8 shows an exploded perspective view of a part of the reversing linkage. It comprise a base member 110 provided with a base 111 which reviews at one end of barrel 112. The other end of the barrel is provided with an actuator pin 114 which is provided at a position which is radially offset from the axis of rotation of the barrel 112.

The pin 114 is received in a slot 116 in a link arm 117. The slot is positioned at a suitable location in the arm 117 depending on the design of the linkage arrangement and the forces required but in this case it is generally, centrally located between two pints 118 and 119. In this case, the pin 119 is longer than the pin 118 but this need not be the case and will again depend on the exact design of the remainder of the linkage arrangement.

The pins 118, 119 on the link arm 117 are received in respective slots 120, 121 in a free-plate 124 which is fixed of the base member 110. The slot 120 is provided with a cross-slot 122 whose purpose will be explained later.

Figure 9:
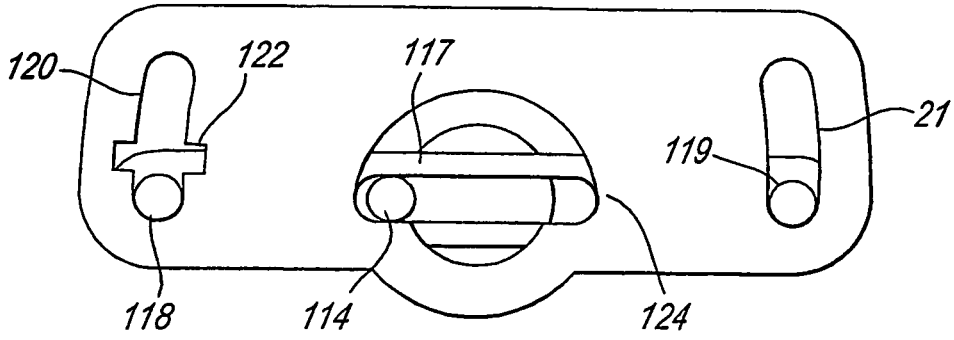
FIG. 9 is a front view of the linkage of FIG. 8 in a first condition.

Turning now to FIG. 9, this shows the arrangement of FIG. 8 in an assembled condition and the same reference numerals are used for the same part. FIG. 9 shows the device at rest in its datum position with the pin 119 biased to the position shown by a spring between the pin 114 on the barrel 112 and the pin 119.

An electrically operated device such as a piezo-electric actuator sits above the mechanism and is arranged such that it will cause insertion into and rejection from the cross-slot 122 of a blocking member. The member is a good fit into the cross-slot 122 and interferes with its movement of the pin 118 away from its rest position as shown in FIG. 9.

Figure 10:
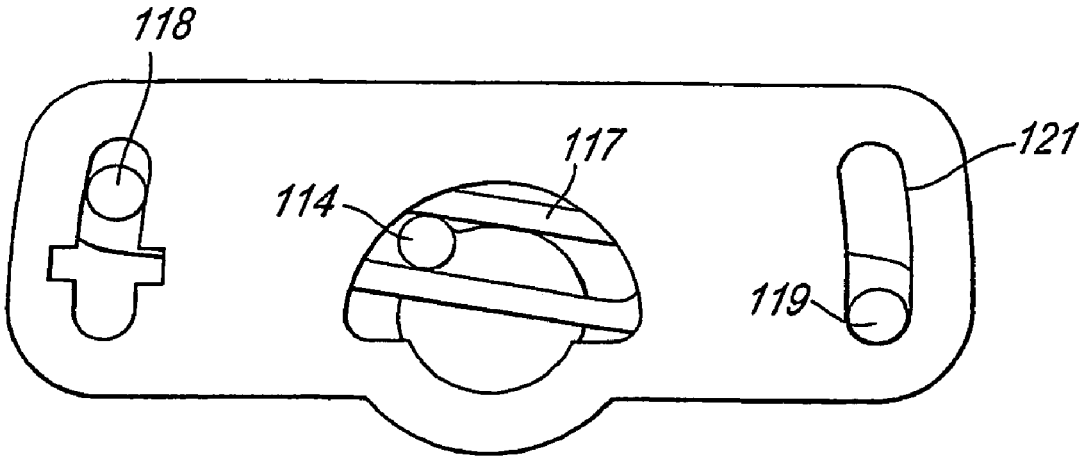
FIG. 10 is a front view of a linkage of FIG. 8 in a second condition.

In FIG. 10, again the same parts use the same reference numerals but here the barrel 112 has been rotated in a clockwise direction. This has caused the link arm 117 to pivot in a clockwise direction about the pin 119 which in turn has caused the pin 118 to rise in the slot 120 in view of the fact that there is no blocking member in the cross-slot 122. Thus, if the pin 119 is used as an output member for the lock, rotation of the barrel 112 has not resulted in any movement of the pin 119.

Figure 11:
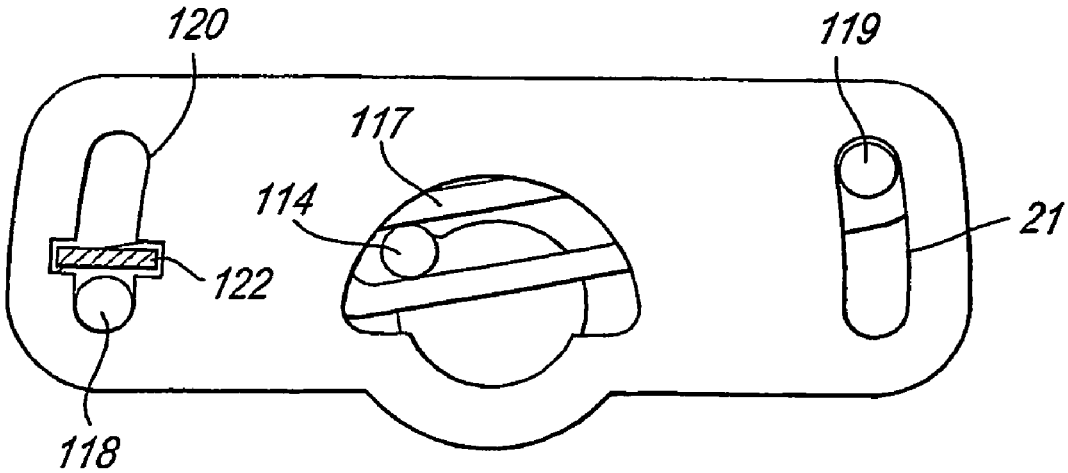
FIG. 11 is a front view of the linkage of FIG. 8 in a third condition.

However, if the blocking member is present in the cross-slot 122, movement of the pin 118 in the slot 120 is inhibited and so rotation of the barrel 112 in a clockwise direction will result in the link arm being forced to pivot in an anti-clockwise direction to raise the pin 119 in the slot 121 as shown in FIG. 11.

It will be appreciated that various modifications may be made to the above mechanism. For example, the pin 118 as well as the pin 119 could be used as an output which would mean that motion in one direction of the barrel 112 could be translated into motion in one or other direction depending on the state of actuation of the electrically operated device. Also, the barrel could be replaced by a slider such as might be used in a locking bolt or by a cam that is connected to a key barrel thus providing a lock that requires both a mechanical key and an electronic signal to operate.

The invention claimed is:

1. A yarn transfer system comprising:

a clamp for clamping a filament;

a collapsing pivot linkage mechanism that coverts a force used to move the clamp in a first direction into the force used to move the clamp in a second direction;

a piezo-electric trigger device system that controls the change of state of the collapsing pivot linkage; and an electronic circuit connected to the piezo-electric of the trigger system for actuating the trigger device, wherein the clamp is a rotary clamp with its axis of rotation aligned in the direction of maximum acceleration.

2. A yarn transfer system according to claim 1, wherein electronic circuit comprises a photosensitive element arranged to cause the trigger device to be actuated when a predetermined level of light is introduced.

3. The pivot yarn transfer system according to claim 1 for connection with rotary clamp member comprising:

a first linkage member arranged to rotate about a first fixed pivot, with said linkage member being rigidly connected to the rotary clamp member to enable said clamp to also rotate around said fixed point;

a second linkage member which is rotatably connected to a first pivotal position on the first linkage member;

a third linkage member with a link pivot which is arranged to rotate about a second fixed pivot with said third linkage member being rotatably connected to a reaction pivot on the second linkage member.

4. The pivot yarn transfer system of claim 1, wherein: said rotary clamp is mounted on a rapier adapted for use in a rapier loom.

* * * * *